US011623214B2

(12) United States Patent
Jackson

(10) Patent No.: US 11,623,214 B2
(45) Date of Patent: Apr. 11, 2023

(54) FLUIDIC CARD ASSEMBLY

(71) Applicant: Randox Laboratories Ltd, Crumlin (GB)

(72) Inventor: Stuart Jackson, Crumlin (GB)

(73) Assignee: RANDOX LABORATORIES LTD, Crumlin (GB)

( * ) Notice: Subject to any disclaimer, the term of this patent is extended or adjusted under 35 U.S.C. 154(b) by 257 days.

(21) Appl. No.: 16/772,593

(22) PCT Filed: Dec. 7, 2018

(86) PCT No.: PCT/GB2018/053559
§ 371 (c)(1),
(2) Date: Jun. 12, 2020

(87) PCT Pub. No.: WO2019/116009
PCT Pub. Date: Jun. 20, 2019

(65) Prior Publication Data

US 2020/0384459 A1 Dec. 10, 2020

(30) Foreign Application Priority Data

Dec. 14, 2017 (GB) ..... 1720869

(51) Int. Cl.
*B01L 3/00* (2006.01)

(52) U.S. Cl.
CPC ..... *B01L 3/502* (2013.01); *B01L 2200/0636* (2013.01); *B01L 2200/0684* (2013.01);
(Continued)

(58) Field of Classification Search
CPC ..... B01L 2200/0636; B01L 2300/0627; B01L 2300/0636; B01L 2300/0816; B01L 3/502
See application file for complete search history.

(56) References Cited

U.S. PATENT DOCUMENTS 4,849,340 A * 7/1989 Oberhardt ..... B01F 35/7172 422/417
2003/0040011 A1* 2/2003 Barth ..... G01N 35/028 435/7.1
2017/0138935 A1 5/2017 Rivas

FOREIGN PATENT DOCUMENTS

WO 8807666 A1 10/1988
WO 2013106458 A2 7/2013

OTHER PUBLICATIONS

Chen et al., "A Rapid and Low-Cost Procedure for Fabrication of Glass Microfluidic Devices," Journal of Microelectromechanical Systems, October, vol. 16, No. 5, pp. 1193-1200. (Year: 2007).*
(Continued)

*Primary Examiner* — Young J Kim
(74) *Attorney, Agent, or Firm* — Banner & Witcoff, Ltd.

(57) ABSTRACT

A fluidic card assembly (1) comprises an inlet (20) for introducing a fluid to the fluidic card assembly (1), a turbulent flow portion (30) downstream of the inlet (20), the turbulent flow portion (30) comprising a widening fluid channel (31) whereby a fluid introduced via the inlet (20) channel undergoes turbulence, and a laminar flow portion (40) downstream of the turbulent flow portion (30). The laminar flow portion (40) is configured to allow fluid passing from the turbulent flow portion (30) into the laminar flow portion (40) to establish a laminar flow pattern, and is configured to house a biochip (44) such that a fluid in the laminar flow portion (40) may be in contact with the biochip (44).

12 Claims, 2 Drawing Sheets

(52) U.S. Cl.
CPC . *B01L 2300/041* (2013.01); *B01L 2300/0627* (2013.01); *B01L 2300/0816* (2013.01); *B01L 2300/0848* (2013.01); *B01L 2400/0487* (2013.01)

(56) References Cited

OTHER PUBLICATIONS

Feb. 12, 2019—ISR & WO—PCT/GB2018/053559.

* cited by examiner

FLUIDIC CARD ASSEMBLY

CROSS-REFERENCE TO RELATED APPLICATIONS

This application is a U.S. National Stage application under 35 U.S.C. § 371 of International Application PCT/GB2018/053559 (published as WO 2019/116009 Al), filed Dec. 7, 2018, which claims the benefit of priority to United Kingdom Patent Application No. UK 1720869.5, filed Dec. 14, 2017. Benefit of the filing date of each of these prior applications is hereby claimed. Each of these prior applications is hereby incorporated by reference in its entirety.

The present invention relates to a fluidic card assembly. Specifically, the present invention is directed at a fluidic card assembly for delivering fluid samples to biochips.

Biochips comprise one or more chemically active test sites, called discrete test regions, disposed on the surface of a substrate. The discrete test regions are configured to immobilise specific biomarkers present in a sample that is in contact with the biochip, and determining which test regions on a biochip have been activated yields information regarding the composition of a sample. In conventional biochip assays, the test regions are configured to emit light when reacting with biomarkers, thereby providing a means of analysing the chip. Biochips enable a user to perform multiple tests simultaneously with minimal user interaction, and have applications in, for example, forensics, medical diagnostics and pharmaceutical research.

Conventionally, samples are delivered to biochips by dropping fluid from a pipette onto a surface of the biochip housed in an open well. The biochip may be heated and physically agitated to homogenise the sample and encourage an even distribution across the surface. However, procedures of this nature typically involve the use of relatively large volumes of fluid in order to sufficiently cover the biochip, and heating and agitating the chip consumes energy and may provoke undesired chemical changes in the sample. Furthermore, the biochip and the sample are exposed to their surroundings in such procedures. This may be problematic where the sample contains hazardous or volatile material, and may incur the risk of contaminating the sample.

U.S. Pat. No. 4,849,340 describes a reaction slide for use in liquid assays. This assembly includes a covered reaction space and a conduit through which a liquid sample can be drawn into the reaction space by capillary action. The conduit is connected to the reaction space by tapering walls. A dry reagent is situated inside the reaction space and the liquid sample, once introduced via the conduit, reacts with the dry reagent. The stationary liquid inside the reaction volume can be monitored as the reaction proceeds. The reaction space has a small volume in order to encourage capillary action, and assays can consequently be carried out using relatively small volumes of fluid. In a reaction slide of the kind described in U.S. Pat. No. 4,849,340, the liquid sample inside the reaction space may not be well-mixed. This would be detrimental in a biochip assay, since, for the assay to be reliable, the composition of the sample delivered to different discrete test regions situated at different points inside the reaction space should be as uniform as possible. There is therefore a need for a way of delivering a homogenous sample across the surface of a biochip in a biochip assay.

WO2017072513 A1 discloses a fluidic card assembly for delivering a fluid sample via a channel arranged on the surface of a biochip. The channel is arranged to pass over discrete test regions on the surface of the biochip such that when a fluid is passed through the channel, it comes into direct contact with the test regions. The channel needs only to be sufficiently wide to amply cover each test region, and agitation is not required as fluid is forced directly onto the test regions. The quantity of fluid required to perform an assay with this apparatus is therefore less than where the sample is dropped onto the surface, and forcing the fluid into contact with each test region increases the likelihood of biomarkers being captured. A membrane may be used to secure the biochip against the channel, thereby sealing the biochip against its surroundings. However, this solution requires a physical structure to be imposed directly on the surface of the biochip so as to construct the fluid channel. This reduces the amount of space on the biochip that is available for testing, thereby limiting the number of tests that may be performed in a single biochip assay.

It is therefore desirable to provide a means of delivering a fluid sample to a biochip in a sealed environment that does not require an additional physical structure to be formed on the surface of the biochip.

In accordance with a first aspect of the present invention, a fluidic card assembly comprises: an inlet for introducing a fluid to the fluidic card assembly, a turbulent flow portion downstream of the inlet, the turbulent flow portion comprising a widening fluid channel whereby a fluid introduced via the inlet channel undergoes turbulence, and a laminar flow portion downstream of the turbulent flow portion, the laminar flow portion being configured to cause fluid passing from the turbulent flow portion into the laminar flow portion to establish a laminar flow pattern; and wherein the laminar flow portion is configured to house a biochip such that a fluid in the laminar flow portion may be in contact with the biochip.

An advantage of the fluidic card assembly according to the above aspect of the invention is that a fluid passed through it may be homogenised by turbulence and then transported evenly through the laminar flow portion. This provides an effective and reliable means of delivering a fluid sample to a biochip without the use of apparatus that limits the available surface area of the chip. It is thereby ensured that biomarkers will be distributed evenly across the surface of a biochip in an assay conducted with this device, and that when the chip is analysed, the intensity of the light emitted by activated biomarkers is comparable across the surface of the biochip.

The combination of the comparatively narrow inlet channel, the expanding turbulent flow portion and the comparatively wide laminar flow portion creates a "Venturi" shape. In this arrangement, fluid passing through the assembly will decelerate in the turbulent flow portion, and will enter the laminar flow portion at a lower speed than that at which it initially travelled through the inlet. Alternative or additional means of inducing turbulence are possible, such as pillars or other obstacles formed inside the turbulent flow portion so as to cause a fluid to rapidly change direction.

Fluid passing through the turbulent flow portion experiences inertial forces associated with its deceleration, thereby raising the Reynolds number of the system in this region. If the Reynolds number substantially exceeds a threshold value, the motion of the fluid will be turbulent. The laminar flow portion is configured to encourage a flow pattern with a Reynolds number below the threshold for turbulent flow.

In a preferred embodiment of the invention, the fluidic card assembly further comprises a biochip housed inside the laminar flow portion. In this embodiment, the assembly may be supplied as a complete unit ready for use, thereby mitigating the risk of contamination that would be incurred by a user manually preparing the assembly for an assay. Alternatively, the fluidic card assembly may be supplied without a biochip, and may be assembled with a biochip by a user.

In a particularly preferred embodiment, the laminar flow portion comprises a fluid channel of a constant width. Such an arrangement encourages the formation of a steady laminar flow pattern in a fluid passing through this section by allowing fluid to flow at a constant speed throughout.

Preferably, the laminar flow portion further comprises a recess in which a biochip may be situated. An advantage of this feature is that a biochip may be housed inside the laminar flow portion without greatly obstructing the motion of a fluid, thereby assisting the creation of a laminar flow pattern.

In a particularly preferred embodiment, the fluidic card assembly includes a biochip, the biochip being housed in the recess, and the recess permits a surface of the biochip situated therein to be flush with an interior surface of the laminar flow portion. In this preferred arrangement, the surface of the biochip on which test regions are situated may be level with the surrounding areas of the inner surface of the laminar flow portion.

Means of securing a biochip inside the recess could include tabs arranged so as to hold the chip in place by its edges, glue, or a low-tack adhesive that permits the biochip to be removed from the fluidic card assembly for further analysis or storage after an assay has been performed. Alternatively, the biochip could be fixed directly to the interior surface of the laminar flow portion by similar means.

Preferably, the fluid channel of the turbulent flow portion comprises an interior surface that: tapers outwardly from the inlet in one plane at an angle in the range of 50-60°, and comprises opposed planar sections each preferably having an area in the range of 20-22 $mm^2$. The opposed planar sections of the interior surface allow the cross-sectional area of this section to be minimised while still providing the effects associated with a widening fluid channel. It is desirable that the cross-sectional area of the channel is as low as possible in order to reduce the volume of fluid required to perform an assay with this device.

The interior surface of the laminar flow portion preferably comprises opposed planar sections. In this arrangement, the interior surface of the laminar flow portion may be formed so as to closely surround the surface of the biochip on which the test regions are situated, thereby allowing the cross-sectional area of this section to be kept at a minimum. Having a low cross-sectional area encourages laminar flow, as the Reynolds number is generally lower in narrow channels, and allows the volume of fluid required to fill the chamber to be kept low.

The fluidic card assembly may further comprise an exhaust portion downstream of the laminar flow portion, the exhaust portion comprising a fluid channel of a greater depth than the laminar flow portion. Air or other gasses may enter the exhaust portion, thereby allowing fluid to pass away from the biochip without causing a backpressure to be hydraulically transmitted upstream and thus preventing backpressures disrupting the laminar flow pattern in the laminar flow portion. Furthermore, the compression of air or other gasses in the exhaust portion by fluid in the assembly causes backpressures to be distributed evenly across the width of the fluid in its plane of motion. This effect promotes a steady flow pattern in the laminar flow portion, and mitigates any non-uniformity that might be encouraged by the differences between the properties of the surfaces of the biochip and the surrounding inner surface of the assembly. The compression of air by fluid in the exhaust portion also reduces the occurrence of bubbles in the fluid. Without an exhaust portion or other means of releasing fluid from the assembly, the system would behave as a gas spring and it might not be possible to completely cover the surface of the biochip.

Preferably, the exhaust portion further comprises one or more outlets for extracting fluid from the fluidic card assembly. Alternatively, the fluidic card assembly could be formed without outlets and instead be configured to collect and retain fluid in the exhaust portion.

The inlet, turbulent flow and laminar flow portions of the fluidic card assembly are preferably sections of a continuous depressed channel formed in a solid housing. Advantageously, the housing may be formed so as to be compatible with conventional analysers, thereby allowing the biochip to be analysed without being removed from the fluidic card assembly. Alternative means of forming the channel are also possible, such as a pipe shaped so as to include the features described herein. Where the fluidic card assembly further comprises an exhaust portion, it is preferable that the exhaust portion is formed in the same housing as the inlet, turbulent and laminar flow portions.

In embodiments in which the inlet, turbulent flow and laminar flow portions of the fluidic card assembly are sections of a continuous depressed channel formed in a solid housing, it is preferable that the assembly further comprises a removable cover secured over the channel so as to form an upper wall of the channel. The cover serves to seal the channel such that fluid may only be introduced and extracted via the designated inlet and outlets, thereby allowing the fluidic card assembly to be used without the sample being exposed to its surroundings. This feature may be advantageous when handling hazardous or volatile samples.

In a method according to a second aspect of the invention, a fluid sample is introduced to a fluidic card assembly according to the first aspect of the invention via the inlet, and a pressure is maintained such that the fluid sample passes through the turbulent flow portion, whereby the fluid undergoes turbulence, and then passes through the laminar flow portion, wherein fluid flowing in a laminar pattern passes over a surface of the biochip.

In a preferred embodiment of the above method, the fluid comprises one or more of a liquid, a suspension, and an emulsion. Where the fluid comprises a suspension, turbulence in the turbulent flow portion has the effect of homogenously distributing the particulate phase contained therein throughout the fluid; and where the fluid comprises an emulsion, turbulence may improve the quality of the emulsion, and homogenise the distribution of droplets throughout the fluid.

In a further preferred embodiment of the above method, the fluid sample comprises a plurality of unmixed or partially-mixed reagents. The reagents are mixed in the turbulent flow portion, thereby causing a reaction to proceed, and the products of the reaction are delivered to the laminar flow portion.

In another preferred embodiment of the above method, introducing a fluid sample to the fluidic card assembly comprises first introducing a first fluid via the inlet, then introducing via the inlet one or more further fluids to be mixed with the first fluid. The fluids are mixed in the turbulent flow portion, thereby allowing a homogenous mixture to be delivered to the laminar flow portion. This method may be advantageous where it is desirable that the fluids to be mixed are kept separate until the assay is performed. For example, a user may wish to study the short-lived products of a particular reaction. In this case, it would be desirable that the fluids are kept entirely separate until absolutely necessary.

An example of a fluidic card assembly according to the present invention and methods for its use in delivering a fluid sample to a biochip will now be described, with reference to the accompanying figures. In the figures.

Figure 1:
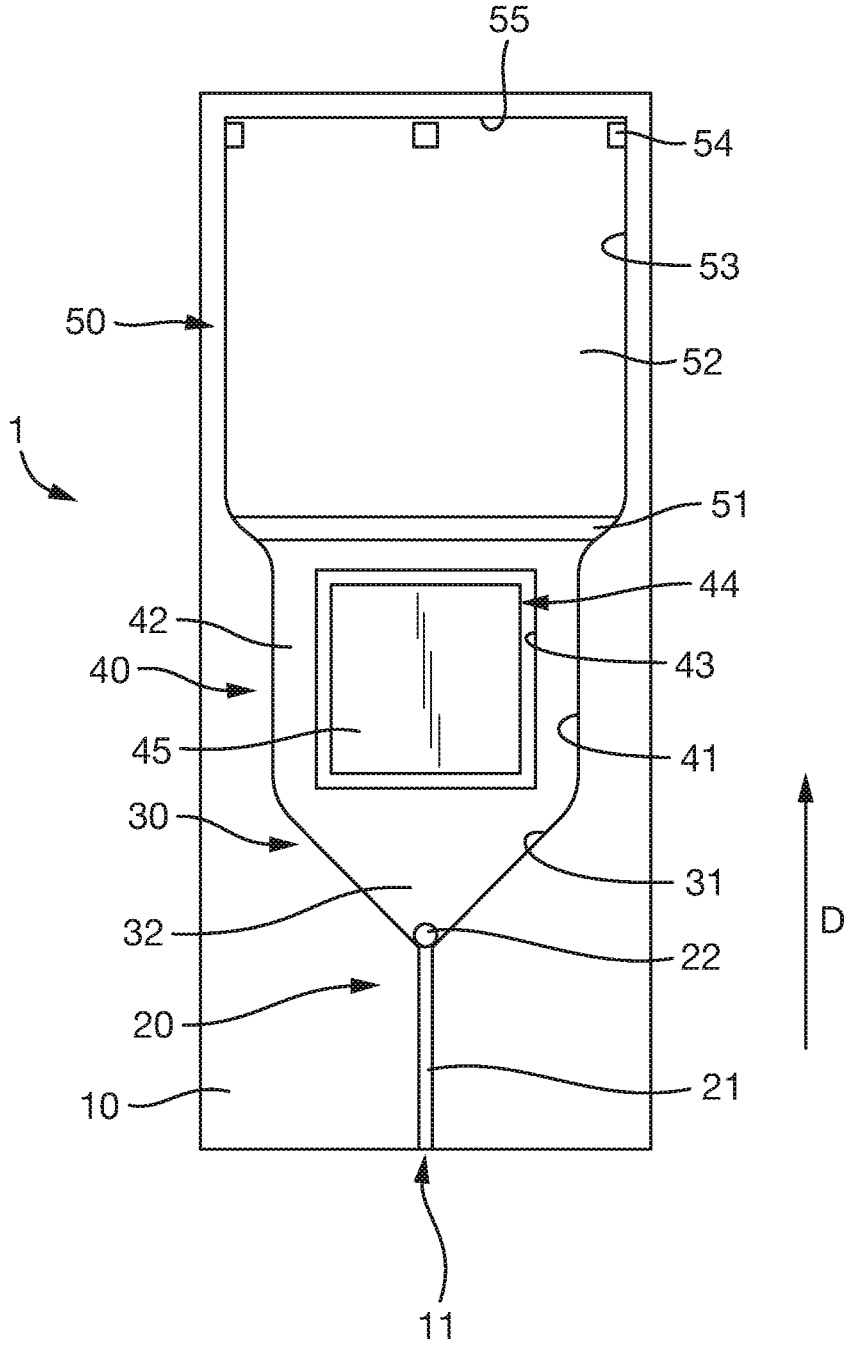
FIG. 1 illustrates a fluid channel formed in a casing.
Figure 2:
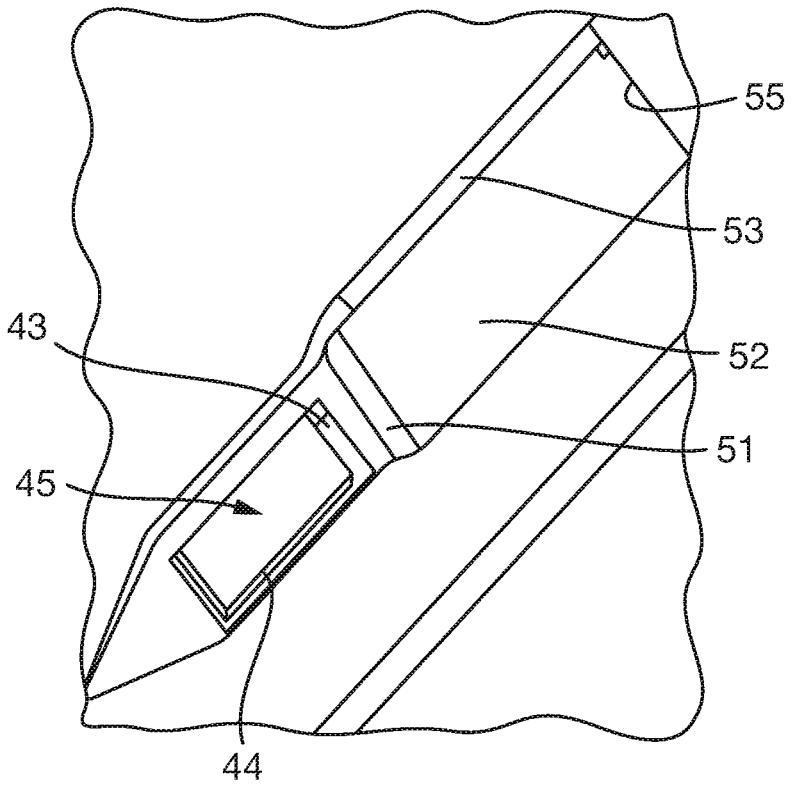
FIG. 2 shows an alternative perspective view of the fluid channel of FIG. 1, illustrating the depth profile of the channel.
Figure 3:
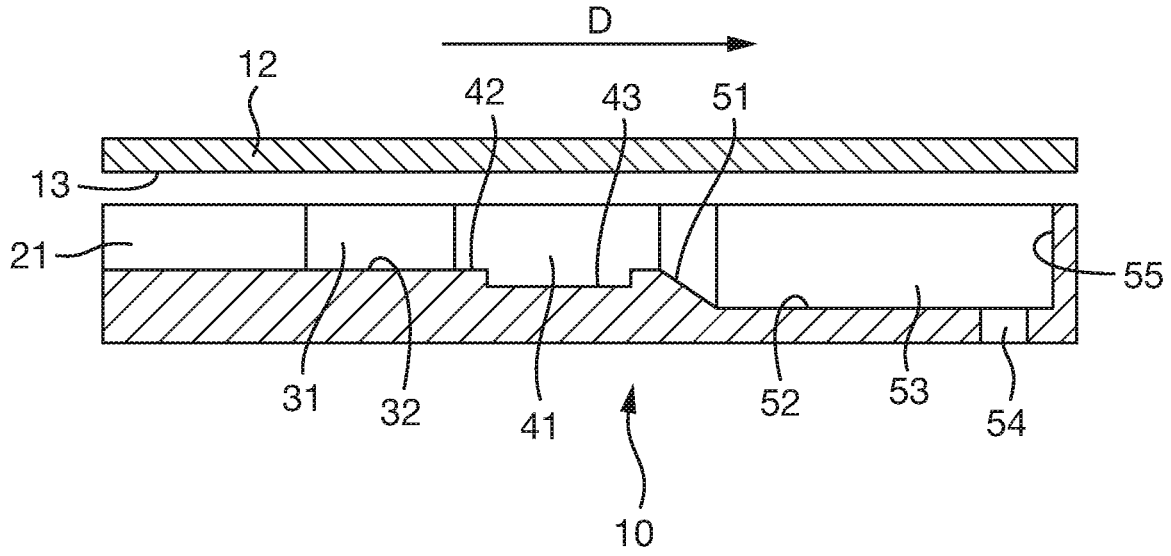
FIG. 3 shows a cutaway view of the channel of FIGS. 1 and 2 and a cover for sealing the top of the channel.

FIGS. 1, 2 and 3 depict an exemplary embodiment of the invention. The fluidic card assembly 1 includes a fluid channel 11 formed within a casing 10. The fluid channel is divided into a number of portions 20, 30, 40, 50 through which a fluid flows consecutively after being introduced to the fluidic card assembly. A cover 12 is provided, and may be secured over the fluid channel 11 so as to seal the fluid channel and allow fluid to be introduced and extracted only via designated inlets and outlets. Securing the cover 12 over the fluid channel 11 causes a surface 13 of the cover to form an upper wall along the extent of the channel.

In this embodiment, the casing 10 is in the form of a rigid card, and the fluid channel 11 is formed as a depression therein. However, the fluid channel 11 could be formed by alternative means, such as a pipe formed to include the features listed above. The cover 12 is preferably a flexible film, but may alternatively be, for example, in the form of a rigid sheet that could be clamped, screwed or fixed by one or more hinges to the casing 10. The cover 12 may be fixed to the casing 10 by laser welding. The cover 12 may be removable so as to allow access to the interior of the assembly.

The casing 10 and the cover are preferably made of plastics or glasses that do not react with the sample compounds and solvents typically used in biochip assays. It is also preferable that the materials used to construct the fluidic card assembly, and particularly the cover, are transparent, so as to permit a fluid located therein to be monitored visually, and to permit analysis of the biochip 44 without requiring the fluidic card assembly to be disassembled. For example, chemiluminscence, which may be observed when test regions on a biochip are activated, might be measured at wavelengths in the range of 300-500 nm. The cover 12 should therefore be transparent over at least this range for assays involving the measurement of chemiluminescence. The cover 12 may, for example, be provided in the form of a polypropylene foil.

An inlet portion 20 comprises an inlet channel 21 that allows a fluid to be introduced to the fluidic card assembly. An upper wall of the inlet channel 21 is formed when the cover 12 is secured over the fluid channel 11. The inlet channel 21 terminates at an aperture 22, through which a fluid may pass into the turbulent flow portion 30. The inlet channel 21 and the aperture 22 preferably have a cross-sectional area in the range of 0.6-0.9 $mm^2$.

The turbulent flow portion 30 of the fluidic card assembly is bounded by two outwardly-tapering side walls 31 formed at an angle preferably in the range of 50-60° to the direction D of flow of a fluid exiting the inlet channel 21 via the aperture 22, and by a lower wall 32, preferably having an area in the range of 20-22 $mm^2$. An upper wall of the turbulent flow portion 30 is formed when the cover 12 is secured over the fluid channel 11.

The tapering of the side walls 31 results in the turbulent flow portion 30 having a cross-sectional area that increases in the downstream direction D. This configuration causes a fluid travelling in the downstream direction D to decelerate, thereby subjecting the fluid to inertial forces sufficient to induce turbulence. The disordered flow pattern that arises where turbulent flow occurs causes the sample to be substantially homogenised.

Downstream of the turbulent flow portion 30 is the laminar flow portion 40. The laminar flow portion is bounded by parallel side walls 41 and a lower wall 42. Formed in the lower wall is a recess 43, which is constructed so as to house a biochip 44. An upper wall of the laminar flow portion 40 is formed when the cover 12 is secured over the fluid channel 11. Preferably, the lower wall of the laminar flow portion has an area in the range of 60-170 $mm^2$.

The laminar flow portion 40 has an approximately constant cross-sectional area in the downstream direction D, so the inertial forces experienced by a fluid travelling through this portion are less than in the turbulent flow portion 30. Furthermore, the increase in the cross-sectional area of the fluid channel through the turbulent flow portion causes a substantial reduction in the flow speed of the fluid after passing through the aperture 22. Subject to the fluid being introduced under suitable conditions, the flow pattern will therefore transition from turbulence to laminarity between the turbulent and laminar flow portions. In embodiments with the preferred dimensions described herein, fluid is typically passed through the fluid channel 11 at a rate of 5-200 μL per minute.

The biochip 44 is a thin slate with dimensions of approximately 9×9 mm. One or more discrete test regions that are capable of immobilising specific biomarkers present in a fluid are arranged on a surface 45 of the biochip in a conventional manner.

The biochip 44 is secured inside the recess 43 such that the surface 45 is on the open side of the recess and may be in contact with a fluid passing through the laminar flow portion. The recess is preferably constructed such that the surface 45 of the biochip is level with the lower wall 42 of the laminar flow portion when the biochip 44 is secured inside the recess. If the dimensions of the biochip and the recess are closely matched, it may not be necessary to provide any additional means of securing the biochip. Otherwise, various means of securing the chip may be employed, such as glue, a low-tack adhesive that permits the biochip to be removed from the fluidic card assembly for further analysis or storage after an assay has been performed, or clips that hold the chip by its edges.

The combination of the turbulent and laminar flow portions as described herein provides a means of first homogenising a sample via turbulence, then ensuring an even distribution of the sample across the surface of a biochip.

Downstream of the laminar flow portion 40 is an exhaust portion 50. A sloping section 51 connects the lower wall 42 of the laminar flow portion to the lower wall 52 of the exhaust portion, thereby causing the depth of the fluid channel to increase. FIG. 2 illustrates the depth profile of the fluid channel 11. The exhaust portion also includes parallel side walls 53 that are formed at a greater separation than those of the laminar flow portion, and an end wall 55. An upper wall of the exhaust portion 50 is formed when the cover 12 is secured over the fluid channel 11. Typically, the lower wall of the exhaust portion has an area of 250 $mm^2$. A plurality of outlets 54 are formed in the downstream end of the exhaust portion, via which a fluid may be extracted from the fluidic card assembly. Air or other gasses may be present in the exhaust portion, thereby mitigating the effect of backpressures created in fluid exiting the assembly and ensuring that the laminar flow pattern in the laminar flow portion is not disrupted. Air or gas in the exhaust portion 50 will be compressed as fluid is urged through the assembly, causing backpressures to be distributed evenly across the plane of motion of the fluid. This effect acts to encourage a uniform flow pattern through the laminar flow portion 40, and mitigates any non-uniformity that might otherwise be caused by the differing characteristics of the surface of the biochip and the surrounding surfaces of the laminar flow portion.

A user may wish to be able to select or prepare biochips suited to particular applications for use with a fluidic card assembly at will. In such instances, the fluidic card assembly of the above embodiment of the invention may be provided without a biochip. The user would manually place a biochip inside the recess 43 and then use the cover 12 to seal the assembly.

One method of using the embodiment of the invention described above involves the introduction of a single fluid sample to the fluidic card assembly via the inlet portion 20. A pressure is maintained so as to cause the fluid to move through the turbulent flow portion 30, wherein the sample experiences turbulence and is substantially homogenised. This pressure could be created using, for example, a pump or a syringe. The fluid then passes into the laminar flow portion 40 and over the biochip 44, activating discrete test regions corresponding to the biomarkers present. Homogenising the fluid upstream of the biochip 44 provides an even distribution of biomarkers across the test surface 45, thereby ensuring that the results of an assay carried out with this apparatus are not biased by initial inhomogeneity in the fluid sample.

The fluid to be homogenised in the fluidic card assembly may be, a single liquid solution, or could include other phases. For example, a user may wish to test a sample in the form of a suspension, which would contain solid particles. The turbulence experienced by the fluid in the turbulent flow portion of the fluidic card assembly would serve to homogenise the distribution of these particles. In a specific example, a user may use a fluidic card assembly according to the present invention to perform an assay involving solid material that has been freeze-dried and later re-entered into the form of a suspension. In another example, the fluid may include an emulsion. Liquid droplets suspended in the sample would be redistributed by turbulence, and the quality of the emulsion may be improved in instances where the turbulent flow pattern is capable of further splitting the droplets.

Fluid samples in other forms may also be used with the embodiment of the invention described above. It may be desirable that a plurality of samples are stored separately but analysed as one. In such instances, the samples may be injected either simultaneously or consecutively into the fluidic card assembly 1, and be mixed in the turbulent flow portion 30. As the inlet channel 21 is typically narrow, the Reynolds number of the system therein is low, and fluids being introduced to the assembly consecutively may initially only mix by diffusion. After entering the turbulent flow portion 30, consecutively introduced fluids also experience mixing by currents.

Where fluids are injected consecutively, it is preferable that the total volume of fluid to be mixed is less than the capacity of the turbulent flow portion 30 so as to ensure complete mixing of the sample.

In an example in which multiple fluids are intended for simultaneous use with a fluidic card assembly according to the present invention, a user may wish to analyse the products of a chemical reaction in its immediate aftermath. They would introduce via the inlet 20 a plurality of fluids containing the reagents to be mixed, which would then interact in the turbulent flow portion 30, wherein the reaction would proceed. The products of the reaction would then be distributed evenly over the test surface 45 of the biochip 44 in the laminar flow portion 40.

The fluidic card assembly 1 of the above embodiment of the invention is intended for use with a conventional analyser. An analyser is capable of determining which discrete test regions have captured biomarkers, thereby providing a record of the composition of a sample. For example, the discrete test regions on the biochip 44 may be configured to produce chemiluminescence when capturing specific biomarkers. In this case an analyser would record the emission of light from the surface 45 of the biochip to determine which discrete test regions have been activated, and therefore which biomarkers are present. Alternatively, biomarkers such as DNA molecules may be labelled with fluorescent tags. Exposing the biochip 44 to, for example, ultraviolet radiation after passing a sample through the assembly would cause fluorescence to be observed where biomarkers are captured.

Other embodiments will be apparent to those skilled in the art from consideration of the specification and practice of the embodiments disclosed herein. It is intended that the specification and examples be considered as exemplary only.

The invention claimed is:

1. A fluidic card assembly comprising:

an inlet comprising an inlet channel for introducing a fluid to the fluidic card assembly, a turbulent flow portion downstream of the inlet, the turbulent flow portion comprising a widening fluid channel whereby a fluid introduced via the inlet channel undergoes turbulence, and a laminar flow portion downstream of the turbulent flow portion, the laminar flow portion being configured to allow fluid passing from the turbulent flow portion into the laminar flow portion to establish a laminar flow pattern;

and wherein the laminar flow portion is configured to house a biochip such that a fluid in the laminar flow portion may be in contact with the biochip; wherein the fluidic card assembly further comprises:

an exhaust portion downstream of the laminar flow portion, the exhaust portion comprising a fluid channel of a greater depth than the laminar flow portion, wherein the exhaust portion comprises a lower wall arranged at a freater depth than a lower wall of the laminar flow portion.

2. The fluidic card assembly of claim 1, wherein the fluidic card assembly further comprises a biochip housed inside the laminar flow portion.

3. The fluidic card assembly of claim 1, wherein the laminar flow portion comprises a fluid channel of a constant width.

4. The fluidic card assembly of claim 1, wherein the laminar flow portion further comprises a recess in which a biochip may be situated.

5. The fluidic card assembly of claim 4, wherein the biochip is housed inside the recess, and where the recess permits a surface of the biochip situated therein to be flush with an interior surface of the laminar flow portion.

6. The fluidic card assembly of claim 1, wherein the inlet comprises an aperture through which fluid may pass into the turbulent flow portion, the aperture having a cross-sectional area in the range of 0.6-0.9 $mm^2$.

7. The fluidic card assembly of claim 1, wherein the fluid channel of the turbulent flow portion comprises an interior surface that:

tapers outwardly from the inlet in one plane at an angle in the range of 50-60°, and comprises opposed planar sections, each having an area in the range of 20-22 $mm^2$.

8. The fluidic card assembly of claim 1, wherein an interior surface of the laminar flow portion comprises opposed planar sections.

9. The fluidic card assembly of claim 1, wherein the exhaust portion further comprises one or more outlets for extracting fluid from the fluidic card assembly.

10. The fluidic card assembly of claim 1, wherein the inlet, turbulent flow and laminar flow portions are sections of a continuous depressed channel formed in a solid housing.

11. The fluidic card assembly of claim 10, wherein the exhaust portion is formed in the same housing as the inlet, turbulent flow and laminar flow portions.

12. The fluidic card assembly of claim 10, wherein the assembly further comprises a removable cover secured over the channel so as to form an upper wall of the channel.

* * * * *